US009657607B2

(12) United States Patent
Brune

(10) Patent No.: US 9,657,607 B2
(45) Date of Patent: May 23, 2017

(54) ROCKER ARM ASSEMBLY AND VALVETRAIN ASSEMBLY INCORPORATING THE SAME

(71) Applicant: GT Technologies, Westland, MI (US)

(72) Inventor: John Edmund Brune, Stockbridge, MI (US)

(73) Assignee: GT Technologies, Westland, MI (US)

( * ) Notice: Subject to any disclaimer, the term of this patent is extended or adjusted under 35 U.S.C. 154(b) by 149 days.

(21) Appl. No.: 14/843,258

(22) Filed: Sep. 2, 2015

(65) Prior Publication Data

US 2016/0061062 A1 Mar. 3, 2016

Related U.S. Application Data

(60) Provisional application No. 62/045,254, filed on Sep. 3, 2014.

(51) Int. Cl.
*F01L 1/18* (2006.01)
*F01M 9/10* (2006.01)
(Continued)

(52) U.S. Cl.
CPC ..... *F01L 1/181* (2013.01); *F01L 1/146* (2013.01); *F01M 9/10* (2013.01); *F01M 9/107* (2013.01);
(Continued)

(58) Field of Classification Search
CPC .. F01L 1/10; F01L 1/146; F01L 1/181; F01M 9/103; F01M 9/107; F01M 11/02
(Continued)

(56) References Cited

U.S. PATENT DOCUMENTS 1,617,986 A 2/1927 Blank
1,624,497 A 4/1927 McAllister
(Continued)

FOREIGN PATENT DOCUMENTS

CN 201679532 U 12/2010
CN 201858036 U 6/2011
(Continued)

OTHER PUBLICATIONS

Communication dated Jan. 22, 2016 enclosing the Extended European Search Report dated Jan. 15, 2016 for European Application No. 15183665.7.

*Primary Examiner* — Jorge Leon, Jr.
(74) *Attorney, Agent, or Firm* — Howard & Howard Attorneys PLLC

(57) ABSTRACT

A rocker arm assembly for translating force between an intermediate member in communication with a camshaft of an internal combustion engine and a valve supported in a cylinder head of the engine. The rocker arm assembly includes a tube member and an arm. The tube member has first and second ends, a substantially cylindrical inner surface, and a tapered outer surface. The arm has a body extending between a pad for engaging the valve of the engine, and a socket for engaging the intermediate member of the engine. The body also has a tapered bore disposed between the pad and the socket. The tapered bore of the body of the arm cooperates with the tapered outer surface of the tube member so as to define a lock for constraining the arm to the tube member at a predetermined position between the first end and the second end.

38 Claims, 13 Drawing Sheets

(51) Int. Cl.

| | |
|---|---|
| ***F01M 11/02*** | (2006.01) |
| ***F01L 1/14*** | (2006.01) |
| *F01L 1/24* | (2006.01) |

(52) U.S. Cl.
CPC ..... *F01M 9/108* (2013.01); *F01M 11/02* (2013.01); *F01L 2001/2427* (2013.01); *F01L 2101/00* (2013.01); *F01L 2105/00* (2013.01); *F01L 2810/02* (2013.01); *F01M 9/103* (2013.01)

(58) Field of Classification Search
USPC ..... 123/90.33, 90.36, 90.39, 90.41, 90.61
See application file for complete search history.

(56) References Cited

U.S. PATENT DOCUMENTS

| | | | | |
|---|---|---|---|---|
| 2,563,699 | A | 8/1951 | Winter, Jr. | |
| 2,667,688 | A * | 2/1954 | Winter, Jr. ..... | F01L 1/181 29/404 |
| 4,497,307 | A | 2/1985 | Paar et al. | |
| 6,230,676 | B1 * | 5/2001 | Pryba ..... | F01L 1/18 123/90.36 |
| 2005/0211206 | A1 | 9/2005 | Ruggiero et al. | |
| 2010/0242878 | A1 | 9/2010 | Maekawa | |
| 2016/0061072 | A1 | 3/2016 | Brune | |

FOREIGN PATENT DOCUMENTS

| | | | |
|---|---|---|---|
| GB | 928585 | A | 6/1963 |
| JP | 6088809 | A | 5/1985 |
| WO | 2009084598 | A1 | 7/2009 |
| WO | 2013020358 | A1 | 2/2013 |

* cited by examiner

ROCKER ARM ASSEMBLY AND VALVETRAIN ASSEMBLY INCORPORATING THE SAME

CROSS-REFERENCE TO RELATED APPLICATIONS

The present application which claims priority to and all the benefits of U.S. Provisional Patent Application No. 62/045,254, filed on Sep. 3, 2014, which is hereby expressly incorporated herein by reference in its entirety.

BACKGROUND OF THE INVENTION

1. Field of Invention

The present invention relates, generally, to engine valvetrain systems and, more specifically, to rocker arm assemblies for a valvetrain assemblies.

2. Description of the Related Art

Conventional engine valvetrain systems known in the art typically include one or more camshafts in rotational communication with a crankshaft supported in a block, one or more intake and exhaust valves supported in a cylinder head for regulating the flow of engine gasses, and one or more rocker arms for translating radial movement from the camshaft to linear movement of the valves. To that end, rocker arms are typically rotatably supported to a shaft which, in turn, is operatively attached to the cylinder head, thereby allowing the rocker arm to pivot about the shaft in response to rotation of the camshaft. The rocker arm typically includes a pad for engaging the valve, and a socket for engaging an intermediate member in communication with the camshaft. As the camshaft rotates, the intermediate member translates movement from the camshaft to the socket of the rocker arm, which pivots the rocker arm such that the pad subsequently translates force to the valve so as to open it. Thus, to effect rotation about the shaft and maintain proper engagement of the pad to the valve, and the socket to the intermediate member, the configuration of the rocker arm can be complicated in terms of geometry and packaging, particularly where the engine application necessitates a narrow-width cylinder head.

Because of the number of different engine types known in the art, the orientation and configuration of valvetrain systems typically varies with the engine application. One well known engine application known in the art, commonly referred to as a "cam-in-block" or "pushrod" engine, utilizes a valvetrain system that includes multiple rocker arms. As the convention suggests, in this application, the camshaft is rotatably supported in the engine block and the valves are supported above the camshaft. The intermediate member is typically a pushrod that engages the socket of the rocker arm at one end, and a hydraulic lash adjuster in communication with the camshaft at another end. In some applications, oil is translated along the intermediate member, such as through the pushrod, along a path going either to or from the rocker arm so as to lubricate and ensure proper rotation about the shaft.

Each of the components of an engine valvetrain system of the type described above must cooperate to effectively translate movement from the camshaft so as to operate the valves. In addition, each of the components must be designed not only to facilitate improved performance and efficiency, but also so as to reduce the cost and complexity of manufacturing and assembling the valvetrain system. While rocker arm assemblies and engine valvetrain systems known in the related art have generally performed well for their intended purpose, there remains a need in the art for a rocker arm assembly that has superior operational characteristics, and, at the same time, reduces the cost and complexity of manufacturing the components of the system, as well as the overall packaging size of the engine.

SUMMARY OF THE INVENTION

The present invention overcomes the disadvantages in the related art in a rocker arm assembly for translating force between an intermediate member in communication with a camshaft of an internal combustion engine and a valve supported in a cylinder head of the engine. The rocker arm assembly includes a tube member and an arm. The tube member has first and second ends, a substantially cylindrical inner surface, and a tapered outer surface. The arm has a body extending between a pad for engaging the valve of the engine, and a socket for engaging the intermediate member of the engine. The body also has a tapered bore disposed between the pad and the socket. The tapered bore of the body of the arm cooperates with the tapered outer surface of the tube member so as to define a lock for constraining the arm to the tube member at a predetermined position between the first end and the second end.

The present invention is also directed toward a valvetrain assembly for translating force between an intermediate member in communication with a camshaft of an internal combustion engine and a valve supported in a cylinder head of the engine. The valvetrain includes an elongated shaft operatively attached to the engine, and a rocker arm assembly rotatably supported on the shaft. The rocker arm assembly includes a tube member and an arm. The tube member has first and second ends, a substantially cylindrical inner surface, and a tapered outer surface. The arm has a body extending between a pad for engaging the valve of the engine, and a socket for engaging the intermediate member of the engine. The body also has a tapered bore disposed between the pad and the socket. The tapered bore of the body of the arm cooperates with the tapered outer surface of the tube member so as to define a lock for constraining the arm to the tube member at a predetermined position between the first end and the second end.

In this way, the present invention significantly reduces the complexity and packaging size of the valvetrain system and its associated components. Moreover, the present invention reduces the cost of manufacturing valvetrain systems that have superior operational characteristics, such as improved engine performance, control, lubrication, efficiency, as well as reduced vibration, noise generation, and packaging size.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
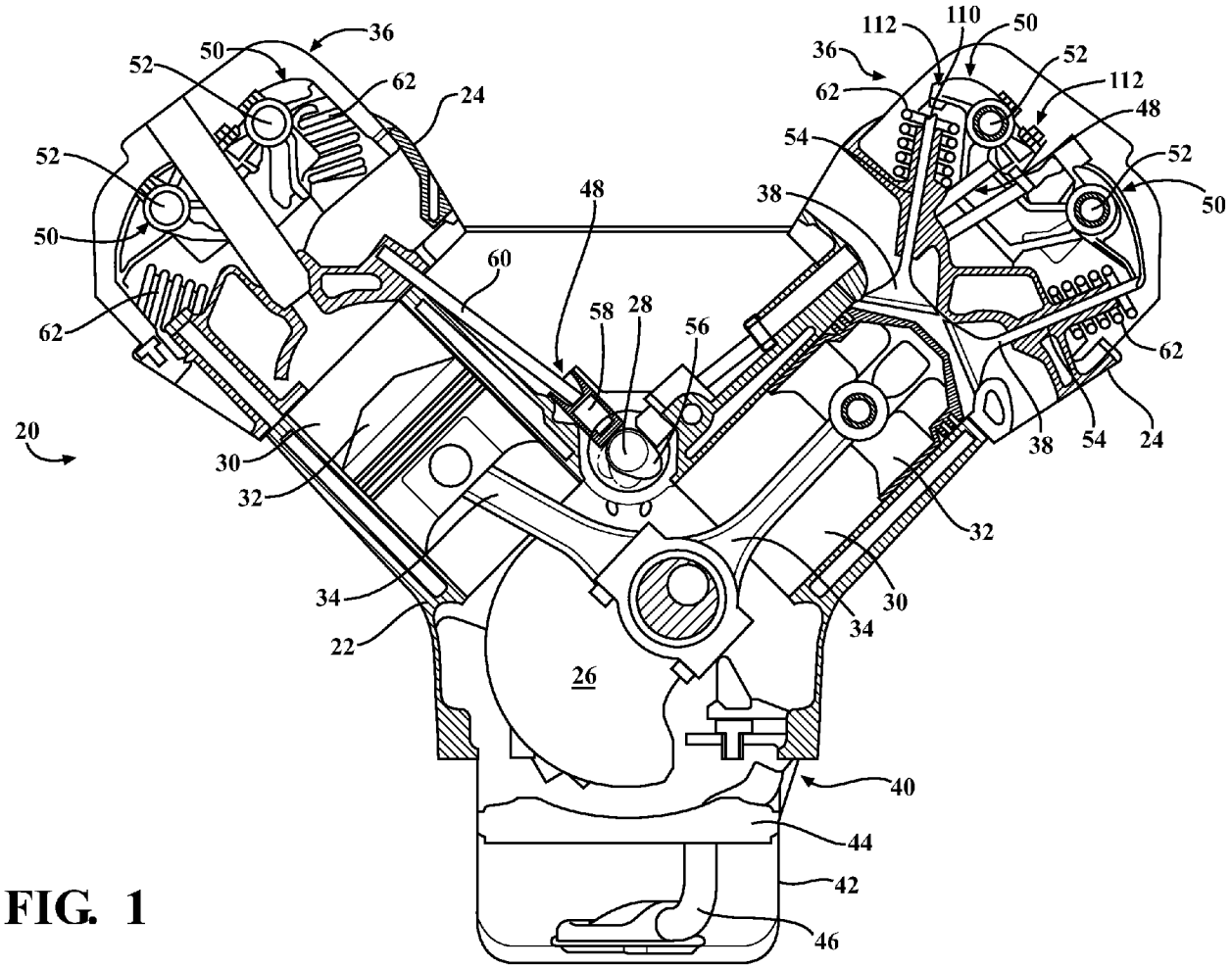
FIG. 1 is a partial front sectional view of an automotive engine showing a camshaft mounted in a block and a pair of cylinder heads.

Referring now to the drawings, where like numerals are used to designate like structure, a portion of an internal combustion engine is illustrated at 20 in FIG. 1. The engine 20 includes a block 22 and one or more cylinder heads 24 mounted to the block 22. A crankshaft 26 is rotatably supported in the block 22, and a single camshaft 28 is rotatably supported in the block 22 spaced from the crankshaft 26. The crankshaft 26 drives the camshaft 28 via a timing chain or belt (not shown, but generally known in the art). The block 22 typically includes one or more cylinders 30 in which a piston 32 is supported and travels along. The piston 32 is pivotally connected to a connecting rod 34, which is also connected to the crankshaft 26.

In operation, combustion in the cylinders 30 of the engine 20 generates rotational torque which is subsequently translated by the crankshaft 26 to the camshaft 28 which, in turn, cooperates with a valvetrain assembly, generally indicated at 36, to control the flow and timing of intake and exhaust gasses between the cylinder heads 24, and the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20.

While the engine 20 illustrated in FIG. 1 is a V-configured, cam-in-block, overhead-valve, pushrod-actuated, spark-ignition Otto-cycle engine, those having ordinary skill in the art will appreciate that the engine 20 could be of any suitable configuration, with any suitable number of camshafts 28 disposed in any suitable way, controlled using any suitable thermodynamic cycle, and with any suitable type of valvetrain 36, without departing from the scope of the present invention. Further, while the valvetrain assembly 36 of the engine 20 is configured for use with automotive passenger vehicles, those having ordinary skill in the art will appreciate that the present invention could be used in any suitable application without departing from the scope of the present invention. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As shown in FIG. 1, the engine 20 also includes a lubrication system 40 used to translate oil from an oil pan 42 mounted to the block 22 adjacent to the crankshaft 26. To that end, the lubrication system 40 typically includes a mechanically-driven oil pump 44 mounted to an end of the crankshaft 26. However, those having ordinary skill in the art will appreciate that the oil pump 44 could be configured or otherwise driven differently. The oil pump 44 is in fluid communication with a pickup tube 46 disposed in the oil pan 42, and translates oil from the oil pan 42 via the pickup tube 46 to various parts of the engine 20 requiring lubrication, such as the crankshaft 26, camshaft 28, and valvetrain assembly 36.

Figure 3:
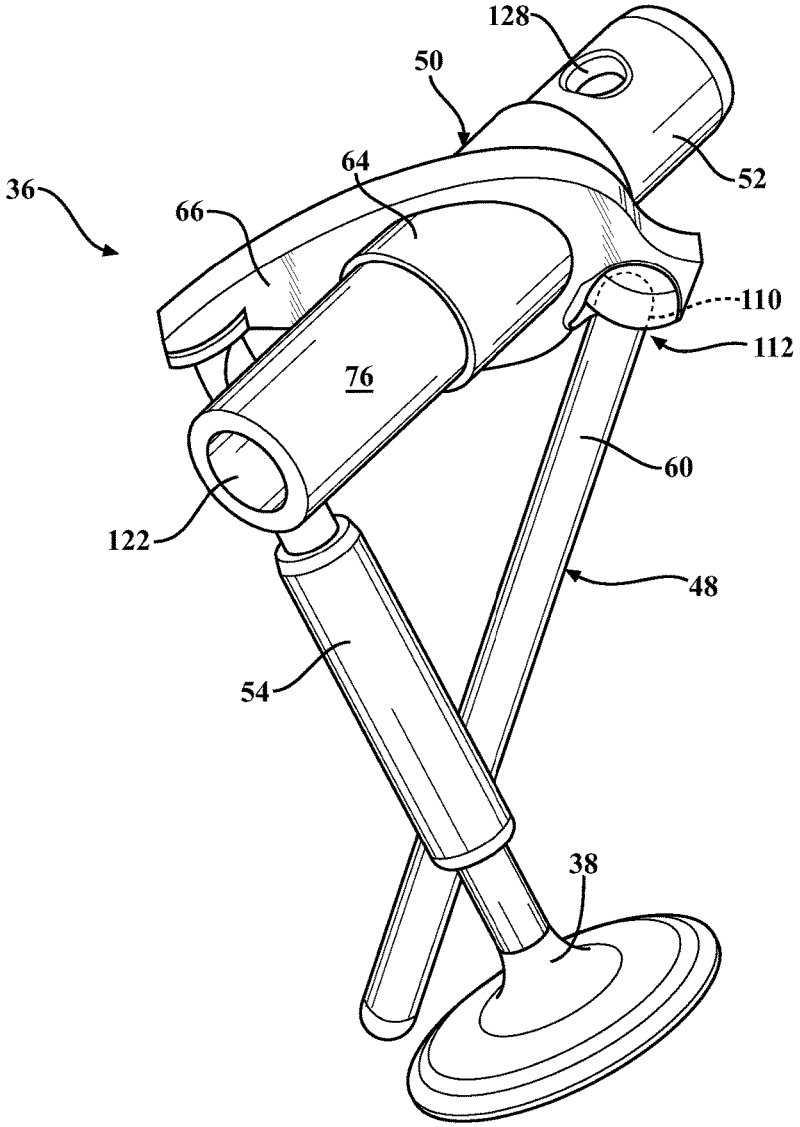
FIG. 3 is a partial perspective view of the valve, valve guide, pushrod, shaft, and rocker arm assembly of FIG. 2.

As shown best in FIGS. 1 and 3, the camshaft 28 cooperates with the valvetrain assembly 36 so as to translate radial movement from the camshaft 28 into linear movement of the valves 38 to control the valve events, as discussed above. More specifically, the valvetrain assembly 36 is used to translate force between one or more intermediate members, generally indicated at 48, and the valves 38. To that end, the valvetrain assembly 36 includes a rocker arm assembly 50 in communication with the valves 38 and intermediate member 48. In addition, in one embodiment, the valvetrain assembly 36 is also used to translate lubrication from the oil pump 44 to the intermediate member 48 and valves 38. To that end, the valvetrain assembly 36 also includes an elongated shaft 52 for supporting the rocker arm assembly 50. Both the rocker arm assembly 50 and the shaft 52 will be described in greater detail below.

As noted above, the arm assembly 50 is used to translate force between the intermediate member 48 in communication with the camshaft 28 and the valve 38 supported in the cylinder head 24. The valve 38 is supported by a valve guide 54 operatively attached to the cylinder head 24. The valve guide 54 allows the valve 38 to travel with respect to the cylinder head 24 in response to rotation of the camshaft 28. To that end, the camshaft 28 includes a plurality of what are typically egg-shaped lobes 56 having a high point 56A and a low point 56B (see FIG. 13). The lobes 56 are in contact with the intermediate member 48 which, in turn, translates radial movement from the camshaft 28 to the rocker arm assembly 50. The interaction of the lobes 56 of the camshaft 28, intermediate member 48, and rocker arm assembly 50 will be described in greater detail below.

Figure 13:
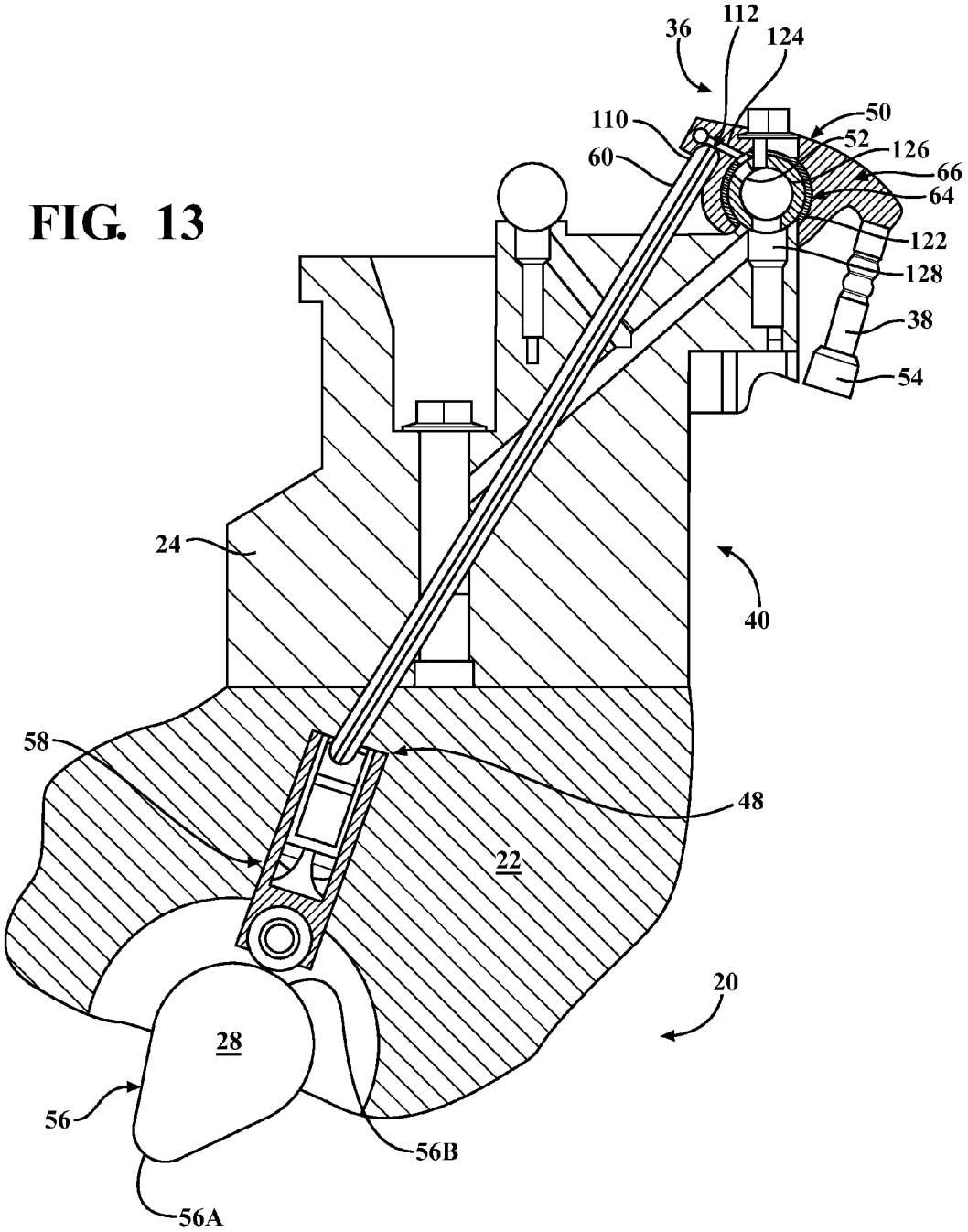
FIG. 13 is an enlarged partial sectional view of the cylinder head and valvetrain system of FIGS. 1 and 2, showing oil flow paths.

As shown in FIGS. 1 and 13, the intermediate member 48 may include a hydraulic lash adjuster 58 as well as a pushrod 60 (not shown in detail, but generally known in the art). Typically, the hydraulic lash adjuster 58 engages the lobe 56 of the camshaft 28, while the pushrod 60 is disposed between and engages both the hydraulic lash adjuster 58 and the rocker arm assembly 50. However, those having ordinary skill in the art will appreciate that the intermediate member 48 could be configured in any way suitable to translate force between the camshaft 28 and rocker arm assembly 50, with or without utilizing a discreet pushrod 60 or hydraulic lash adjuster 58, without departing from the scope of the present invention. When the camshaft 28 rotates such that the high point 56A of the lobe 56 engages the hydraulic lash adjuster 58, the pushrod 60 presses against the rocker arm assembly 50 which, in turn, pushes the valve 38 open. Thus, the egg-shaped profile of the lobes 56 of the camshaft 28 effectively displaces the valve 38. As will be appreciated from the subsequent description of the rocker arm assembly 50, the displacement caused by the profile of the lobes 56 of the camshaft 28 can be effectively multiplied so as to displace the valve 38 further along the valve guide 54.

After the valve 38 has been opened in response to the rotational position of the camshaft 28 lobe, the valve 38 subsequently closes again, following the profile of the lobe 58. To that end, a compression spring 62 is typically disposed around the valve guide 54, supported in the cylinder head 24, and operatively attached to the valve 38 (see FIG. 1). Thus, as the valve 38 opens, the spring 62 compresses against the cylinder head 24 and stores potential energy. As the camshaft 28 continues to rotate, and as the high point 56A of the lobe moves away and the low point 56B engages the hydraulic lash adjuster 58, the potential energy stored in the spring 62 is released, thereby closing the valve 38 in response.

Figure 8:
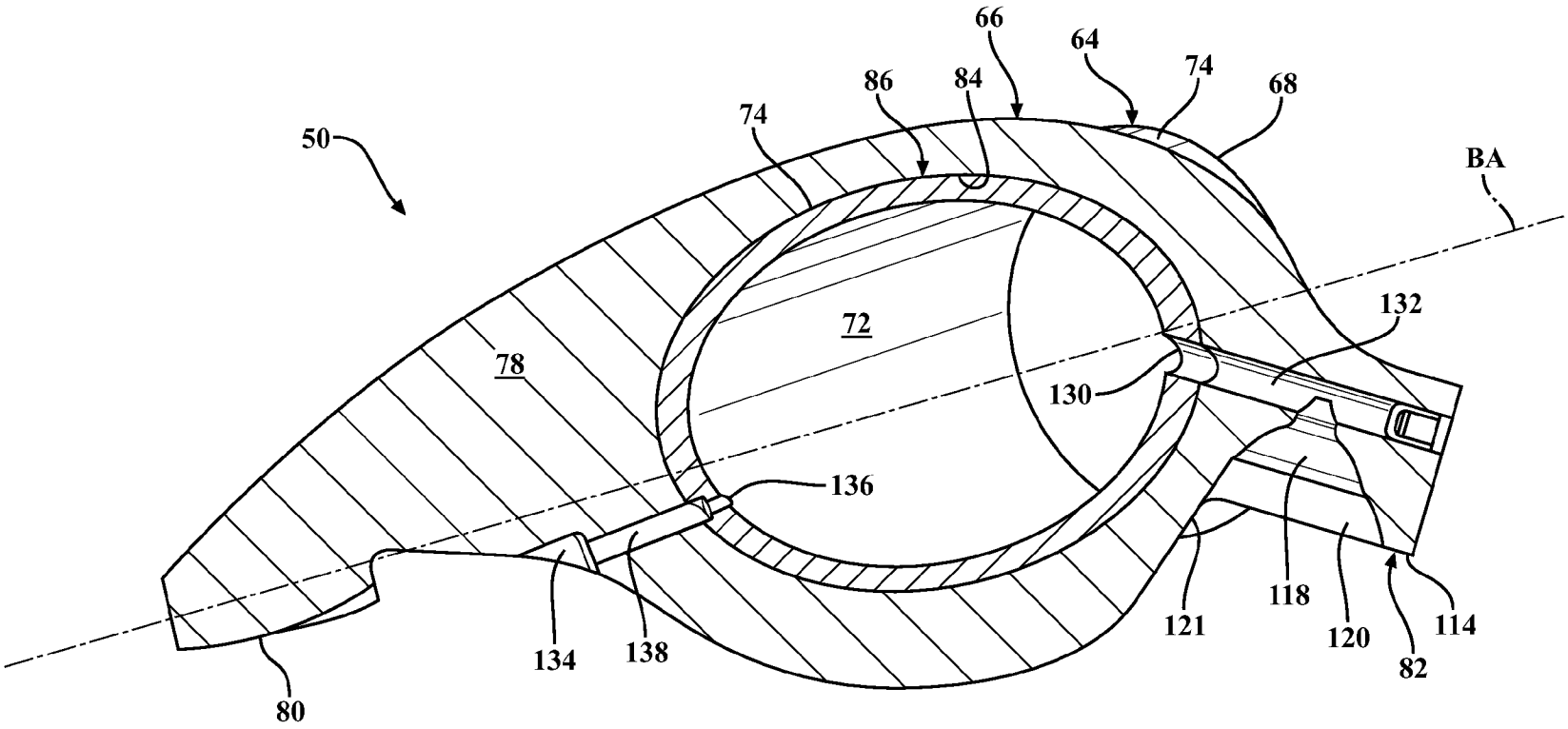
FIG. 8 is a sectional view taken along line 8-8 of FIG. 6.
Figure 9:
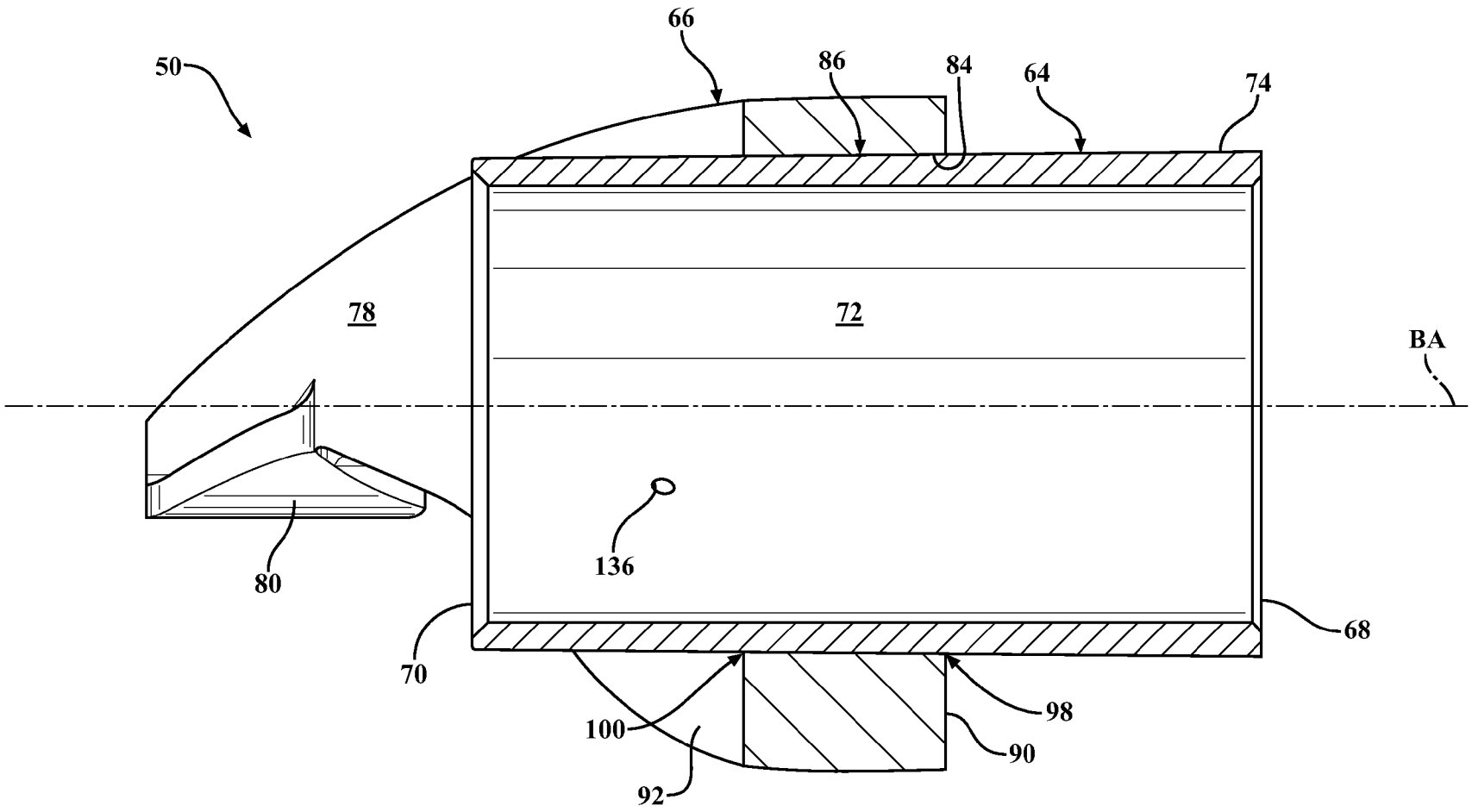
FIG. 9 is a sectional view taken along line 9-9 of FIG. 7.

Referring now to FIGS. 3-11, the rocker arm assembly 50 includes a tube member 64 and an arm 66. The tube member 64 has first and second ends 68, 70, a substantially cylindrical inner surface 72, and a tapered outer surface 74. The inner surface 72 of the tube member 64 is supported by an outer bearing surface 76 of the shaft 52 so as to allow the rocker arm assembly 50 to rotate about the shaft 52 in operation. As best shown in FIG. 9, in one embodiment, the inner surface 72 of the tube member 64 of the rocker arm assembly 50 has a substantially constant diameter between the first end 68 and the second end 70 of the tube member 64 so as to define a substantially congruent bearing surface along the length of the tube member 64. However, those having ordinary skill in the art will appreciate that the inner surface 72 of the tube member 64 could have any suitable profile without departing from the scope of the present invention. By way of non-limiting example, a stepped configuration is conceivable.

Figure 2:
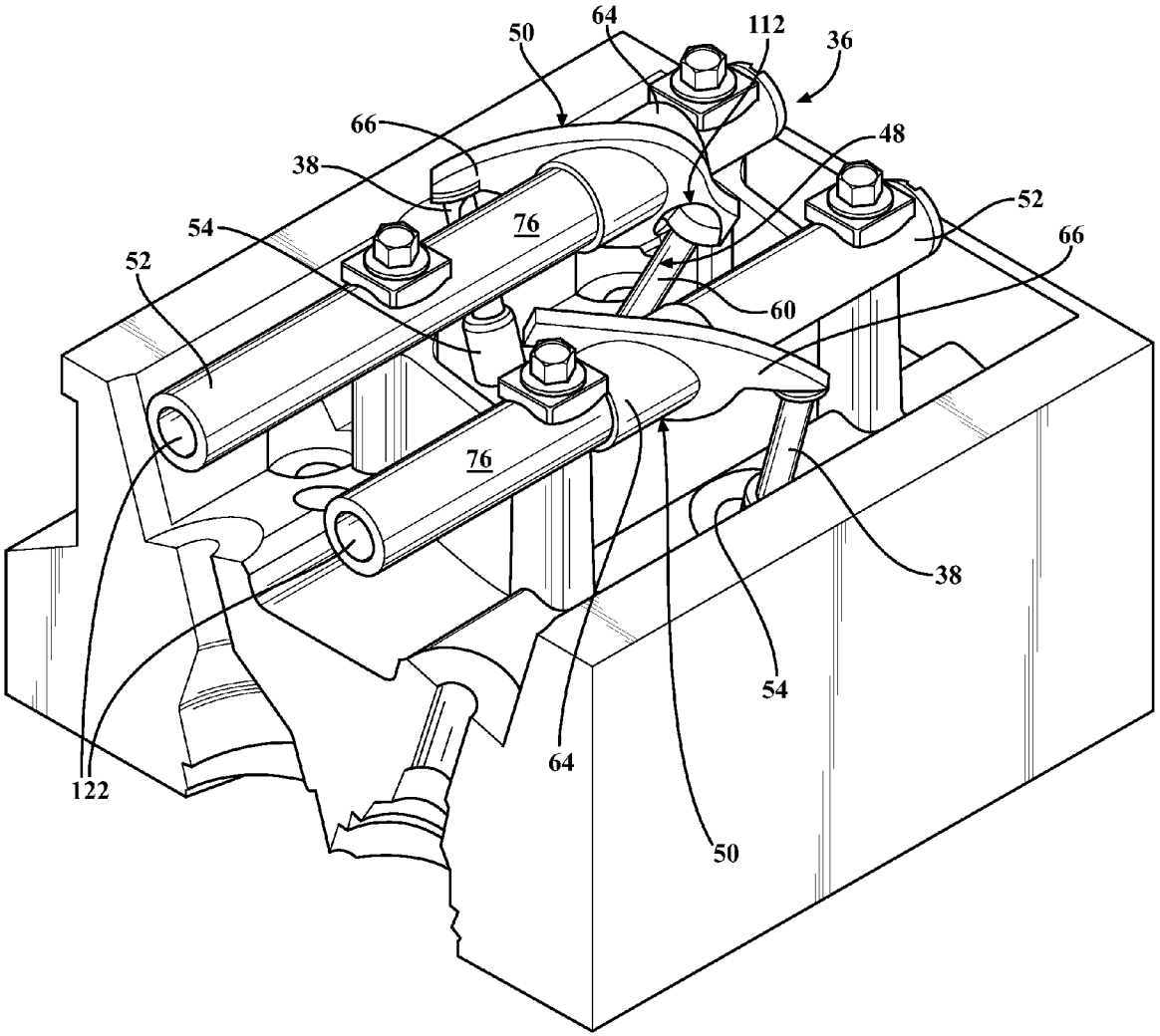
FIG. 2 is a partial perspective view of one of the cylinder heads of FIG. 1 showing a valvetrain system with a pair of shafts, valves, guides, pushrods, and rocker arm assemblies, according to one embodiment of the present invention.

The arm 66 of the rocker arm assembly 50 has a body 78 extending between a pad 80 and a socket 82. The pad 80 is used to engage and press against the valve 38 (see FIGS. 2 and 3). To that end, the pad 80 has a contoured profile configured so to remain substantially engaged to the valve 38 as the rocker arm assembly 50 rotates in operation. The socket 82 is used to engage the intermediate member 48 of the engine 20 (see FIG. 2). The body 78 of the arm 66 also has a tapered bore 84 disposed between the pad 80 and the socket 82 (see FIGS. 10 and 11). In one embodiment, the tapered bore 84 of the arm 66 cooperates with the tapered outer surface 74 of the tube member 64 so as to define a lock 86 for constraining the arm 66 to the tube member 64 at a predetermined position between the first end 68 and second end 70 (see FIGS. 8 and 9). The pad 80, socket 82, tapered bore 84, and lock 86 will be described in greater detail below.

Figure 10:
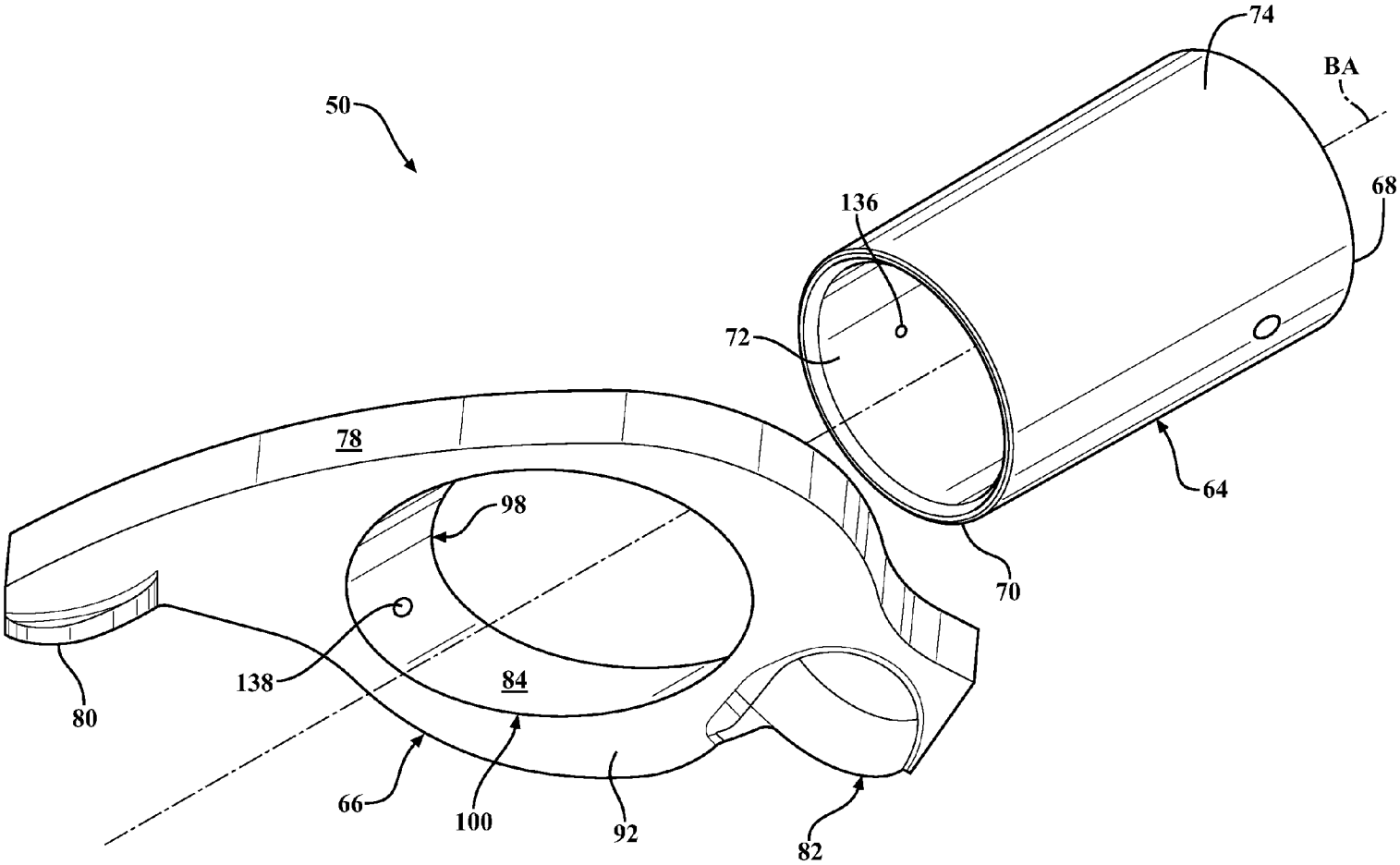
FIG. 10 is an exploded perspective view of the rocker arm assembly of FIG. 4, showing the tube member and the arm in an unassembled configuration.
Figure 11:
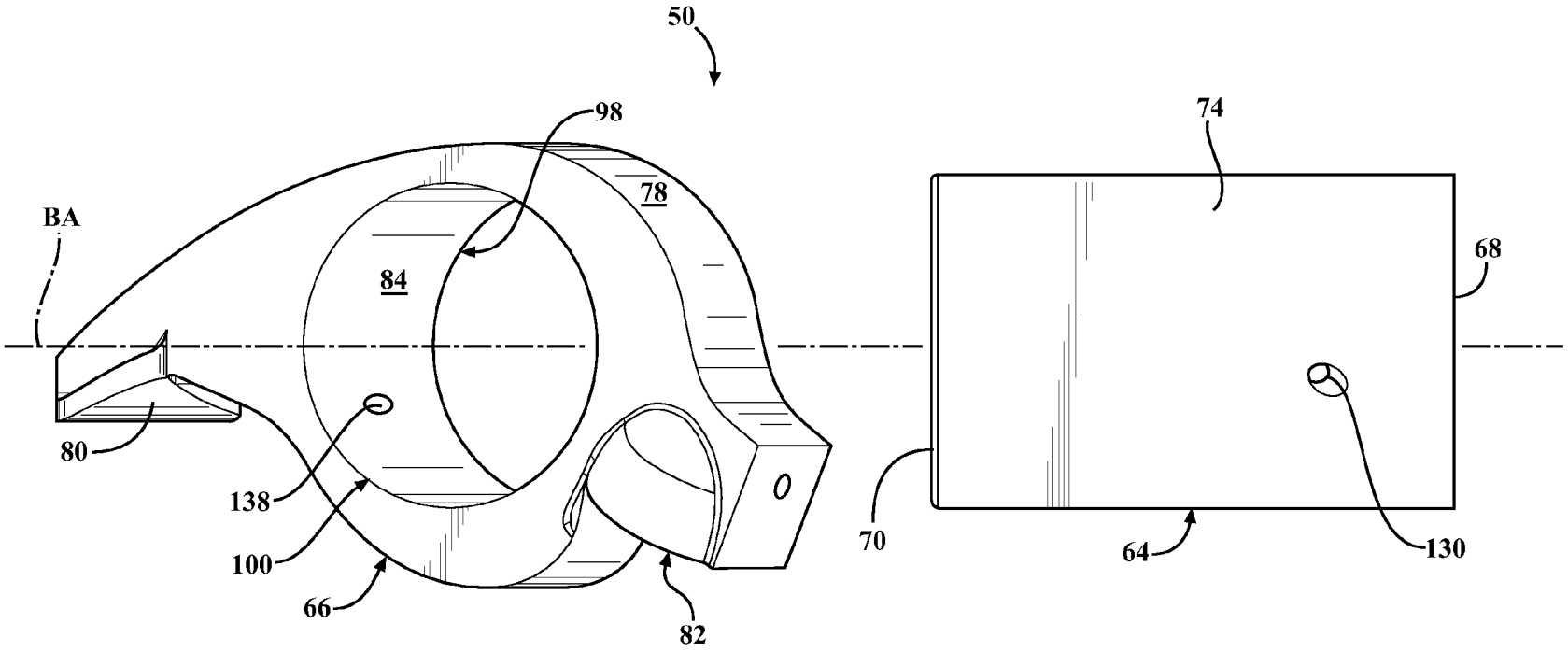
FIG. 11 is an exploded right side plan view of the rocker arm assembly of FIG. 10, showing the tube member and the arm in an unassembled configuration.

As shown in FIGS. 10 and 11, the tube member 64 and the arm 66 of the rocker arm assembly 50 are formed as separate components, whereby the lock 86 aligns and constrains the rocker arm assembly 50 for subsequent attachment. To that end, and in one embodiment, the rocker arm assembly 50 may include a joint, indicated generally at 88, that cooperates with the lock 86 so as to operatively attach the arm 66 to the tube member 64 (see FIGS. 4 and 5). It will be appreciated that the joint 88 could be formed, defined, or otherwise used in a number of different ways. By way of non-limiting example, if the tube member 64 and arm 66 are manufactured from steel and, the joint 88 could be a stake, a braze filler, or a weld pool, whereby the joint 88 is formed via a mechanical operation, a brazing operation, or a welding operation, respectively. Moreover, it will be appreciated that the tube member 64 and arm 66 could be manufactured from any suitable type of material, of the same or different materials or alloys thereof, without departing from the scope of the present invention.

As noted above, the lock 86 of the rocker arm assembly 50 is defined by the cooperation between the tapered bore 84 of the arm 66 and the tapered outer surface 74 of the tube member 64. To that end, as shown best in FIGS. 7 and 9, the body 78 of arm 66 has opposing first and second sides 90, 92 with the tapered bore 84 extending from the first side 90 to the second side 92. The sides 90, 92 are generally flat and merge with the pad 80 and socket 82, whereby sides 90, 92 are spaced from each other at a substantially constant distance, defining the body 78 of the arm 66 with a substantially constant thickness between the pad 80 and socket 82. However, it will be appreciated that the sides 90, 92 could have any suitable configuration, congruent along the length of the arm 66 or otherwise, without departing from the scope of the present invention.

As noted above, depending on the specific engine 20 configuration, the valvetrain assembly 36 may include complex geometry and/or packaging so as to minimize the overall packaging size of the engine. Thus, those having ordinary skill in the art will appreciate that the shape and size of the cylinder heads 24 directly influences the size, configuration, and orientation of the rocker arm assembly 50. In particular, minimizing cylinder head 24 width is desirable for optimizing engine 20 packaging size. Thus, in reducing the width of the cylinder head 24, the rocker arm assembly 50 geometry typically becomes more complex. Specifically, the valve 38 and intermediate member 38 may not be equally spaced from the shaft 52 supporting the rocker arm assembly 50. Moreover, the valve 38 and intermediate member 38 may be angled with respect to one another or to the shaft 52 (see FIG. 3). Thus, the tapered bore 84 of the arm 66 may not be aligned perpendicularly with the sides 90, 92 of the arm 66. As such, in one embodiment, an imaginary longitudinal plane LP is defined between the first side 90 and the second side 92 of the arm 66, and a bore axis BA is defined along the tapered bore 84, whereby the bore axis BA intersects the longitudinal plane LP at an obtuse first angle 96 (see FIG. 6). The obtuse first angle 96 defines a supplementary second angle 94, whereby the sum of the angles 94, 96 is 180-degrees. Advantageously, and in one embodiment, the angles 94, 96 are each less than 135-degrees. However, it will be appreciated that the angles 94, 96 could be of any suitable value without departing from the scope of the present invention. For the purpose of clarity, and to give multi-dimensional reference to the relationships of the longitudinal plane LP and bore axis BA, an imaginary reference plane RP may be defined between the pad 80 and the socket 82 of the arm 66, essentially by the top plan view of FIG. 6, where the reference plane RP intersects the longitudinal plane LP perpendicularly, and the bore axis BA is substantially parallel to the reference plane RP.

Referring now to FIGS. 9-11, the tapered bore 84 of the arm 66 has a first perimeter 98 and a second perimeter 100, with the first perimeter 98 being larger than the second perimeter 100 so as to allow the tapered outer surface 74 of the tube member 64 to engage the tapered bore 84 and effect assembly of the arm 66 and tube member 64. In one embodiment, a ratio between the first perimeter and the second perimeter is less than 1.02:1, thereby optimizing the configuration of the arm 66 and tube member 64 so as to minimize the difficulty in manufacturing the tapered bore 84 of the arm 66 and the tapered outer surface 74 of the tube member 64, as well as to optimize the functionality of the lock 86, as described above. However, it will be appreciated that the perimeters 98, 100 could be configured in any suitable way without departing from the scope of the present invention.

Figure 4:
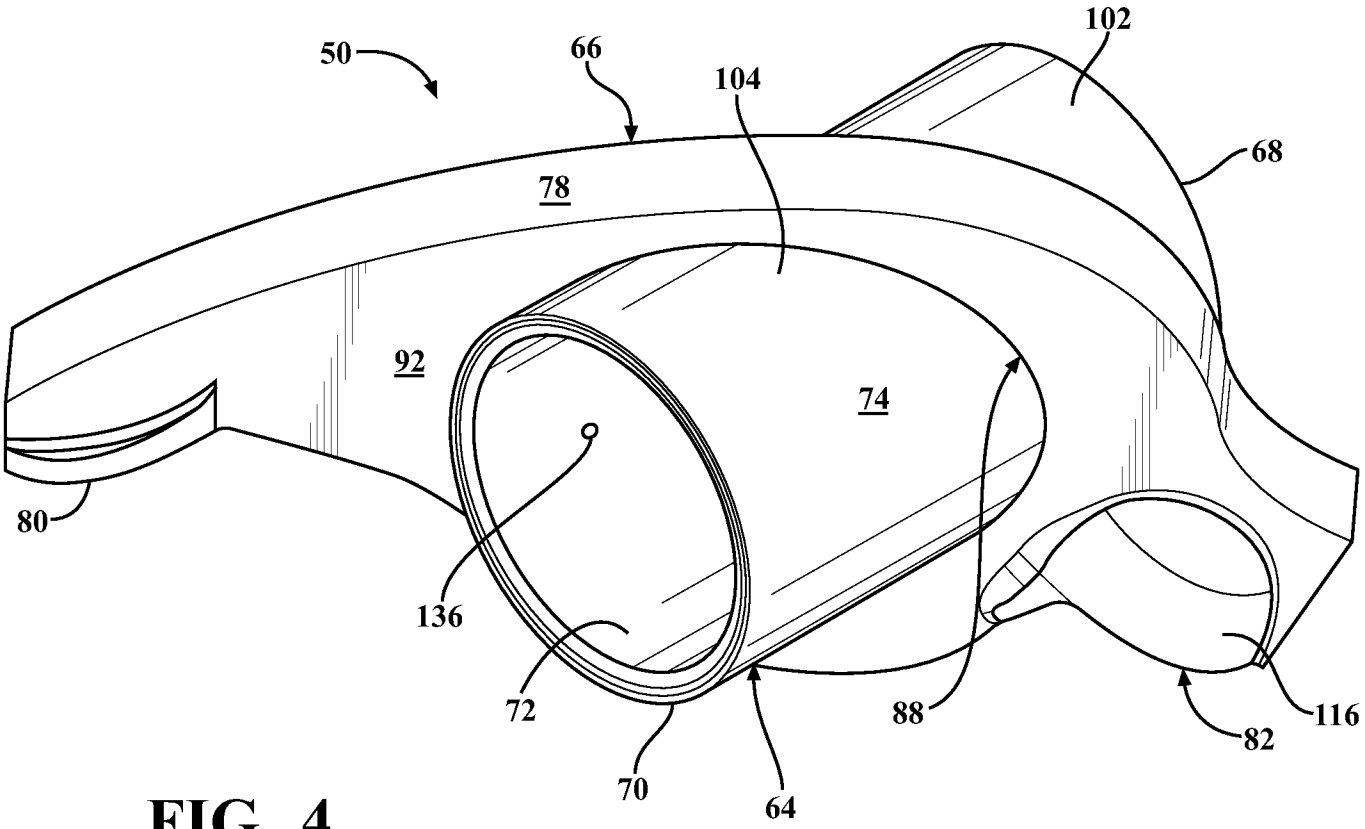
FIG. 4 is an enlarged perspective view of the rocker arm assembly of FIGS. 2 and 3, showing a tube member and an arm in an assembled configuration, according to one embodiment of the present invention.
Figure 5:
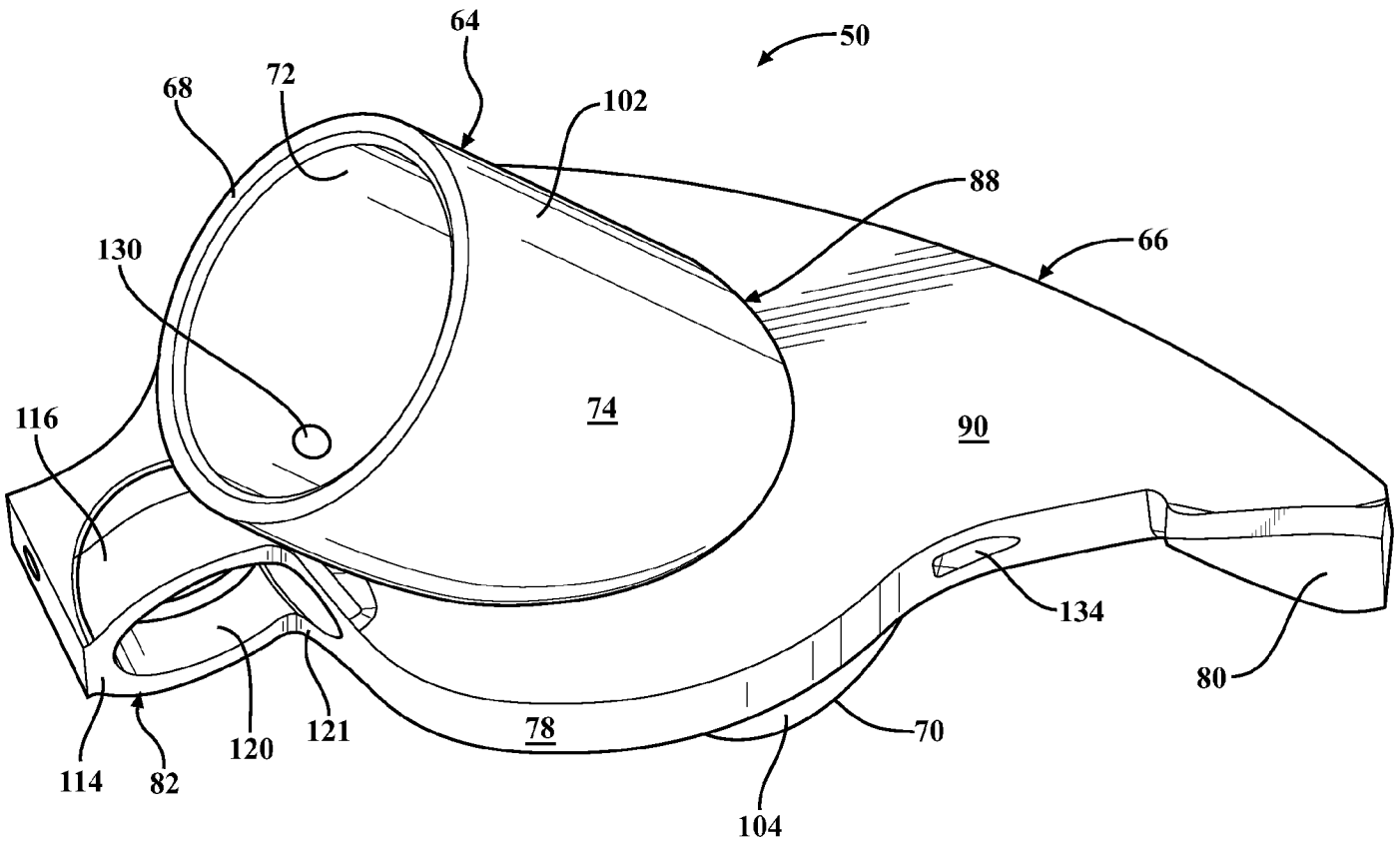
FIG. 5 is a rotated perspective view of the rocker arm assembly of FIGS. 2-4.
Figure 6:
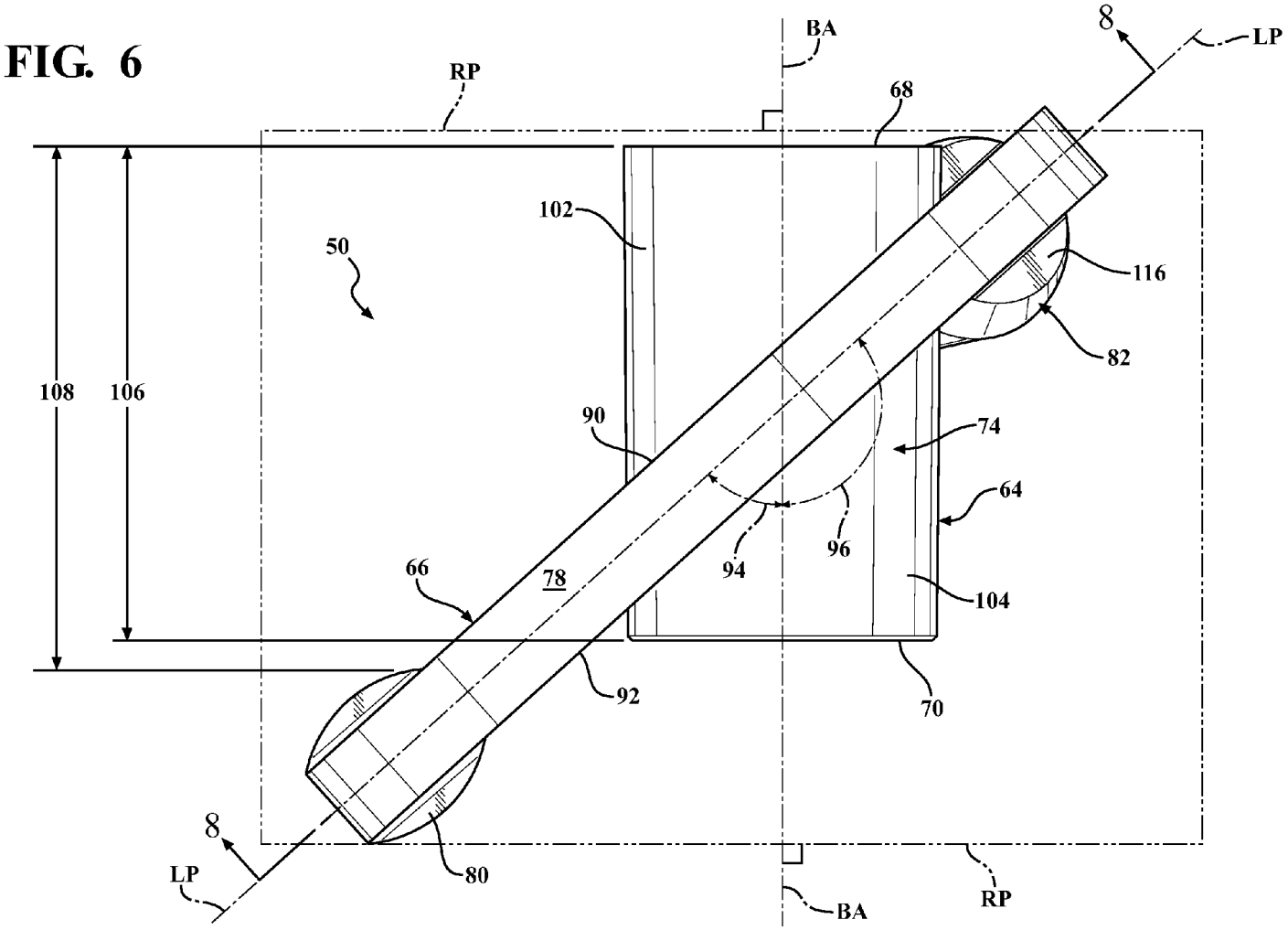
FIG. 6 is a top plan view of the rocker arm assembly of FIGS. 2-5.
Figure 7:
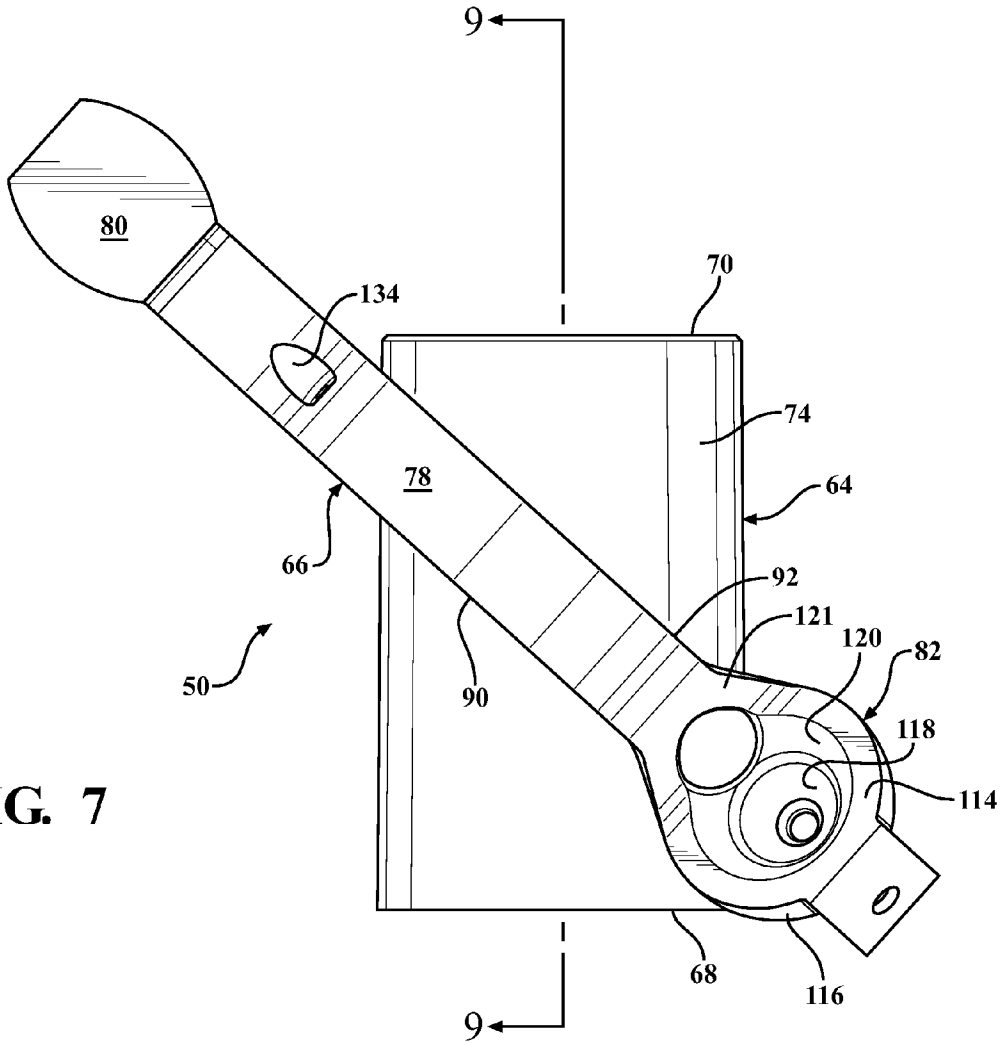
FIG. 7 is a bottom plan view of the rocker arm assembly of FIGS. 2-6.

As best shown in FIGS. 4-6, in one embodiment, a first area 102 of the tube member 64 is defined between the first side 90 of the body 78 of the arm 66 and the first end 68 of the tube member 64. Similarly a second area 104 of the tube member 64 is defined between the second side 92 of the body 78 of the arm 66 and the second end 68 of the tube member 64. The first area 102 is larger than the second area 104 so as to minimize the length of the tube member 64 and thickness of the arm 66, providing sufficient engagement between the tube member 64 and the arm 66, as well as to optimize the distribution of stress and load along the tube member 64 in operation.

In one embodiment, a first distance 106 is defined along the bore axis BA between the first end 68 of the tube member 64 and the second end 70 of the tube member 64. Similarly, a second distance 108 is defined along the bore axis BA between the first end 68 of the tube member 64 and the pad 80 of the arm 66 (see FIG. 6). The second distance 108 is greater than the first distance 106 so as to minimize the length of the tube member 64, thereby reducing the necessary packaging space required for the rocker arm assembly 50 in the cylinder head 24.

As noted above, the socket 82 of the arm 66 of the rocker arm assembly 50 is used to engage the intermediate member 48 of the engine 20. More specifically, the socket 82 engages a ball end 110 of the pushrod 60 (see FIGS. 1, 3, and 13) to define a pivoting connection, indicated generally at 112, which ensures engagement between the intermediate member 48 and the rocker arm assembly 50 at varying respective angles in operation. To that end, the socket 82 includes an upper flange surface 114, an outer socket surface 116, a receiving cup 118, and a clearance cup 120 (see FIGS. 7 and 8). The upper flange surface 114 is spaced from the first side 90 and the second side 92 of the body 78 of the arm 66. The outer socket surface 116 extends between and merges with the upper flange surface 114 and at least one of the first side 90 and the second side 92 of the body 78 of the arm 66. The receiving cup 118 is spaced from the flange surface 114 and is used to engage the intermediate member of the engine, such as the ball end 110 of the pushrod 60. Thus, the receiving cup 118 of the socket 82 cooperates with the ball end 110 of the pushrod 60 to define the pivoting connection 112 described above. The clearance cup 120 is disposed between and merges with the receiving cup 118 and the upper flange surface 114. The clearance cup 120, as the name suggests, contributes to an increased range of motion of the pivoting connection 112 described above. It will be appreciated that the clearance cup 120 facilitates a smooth transition between the receiving cup 118 and the upper flange surface 114 so as to optimize distribution of applied stress occurring during operation of the valvetrain assembly 36 at a relatively high-stress location of the rocker arm assembly 50, while simultaneously affording optimized packing within the cylinder head 24.

In one embodiment, the socket 82 of the arm 66 further includes a transition portion 121 merging the body 78 of the arm 66 with at least a portion of the upper flange surface 114 (see FIG. 5), thereby providing the socket 82 with additional rigidity. Similarly, in one embodiment, the upper flange surface 114 of the socket 82 is spaced from the tube member 64 (see FIGS. 5 and 7), resulting in a congruent upper flange surface 114 with improved load capability and optimized stress concentration.

Figure 12:
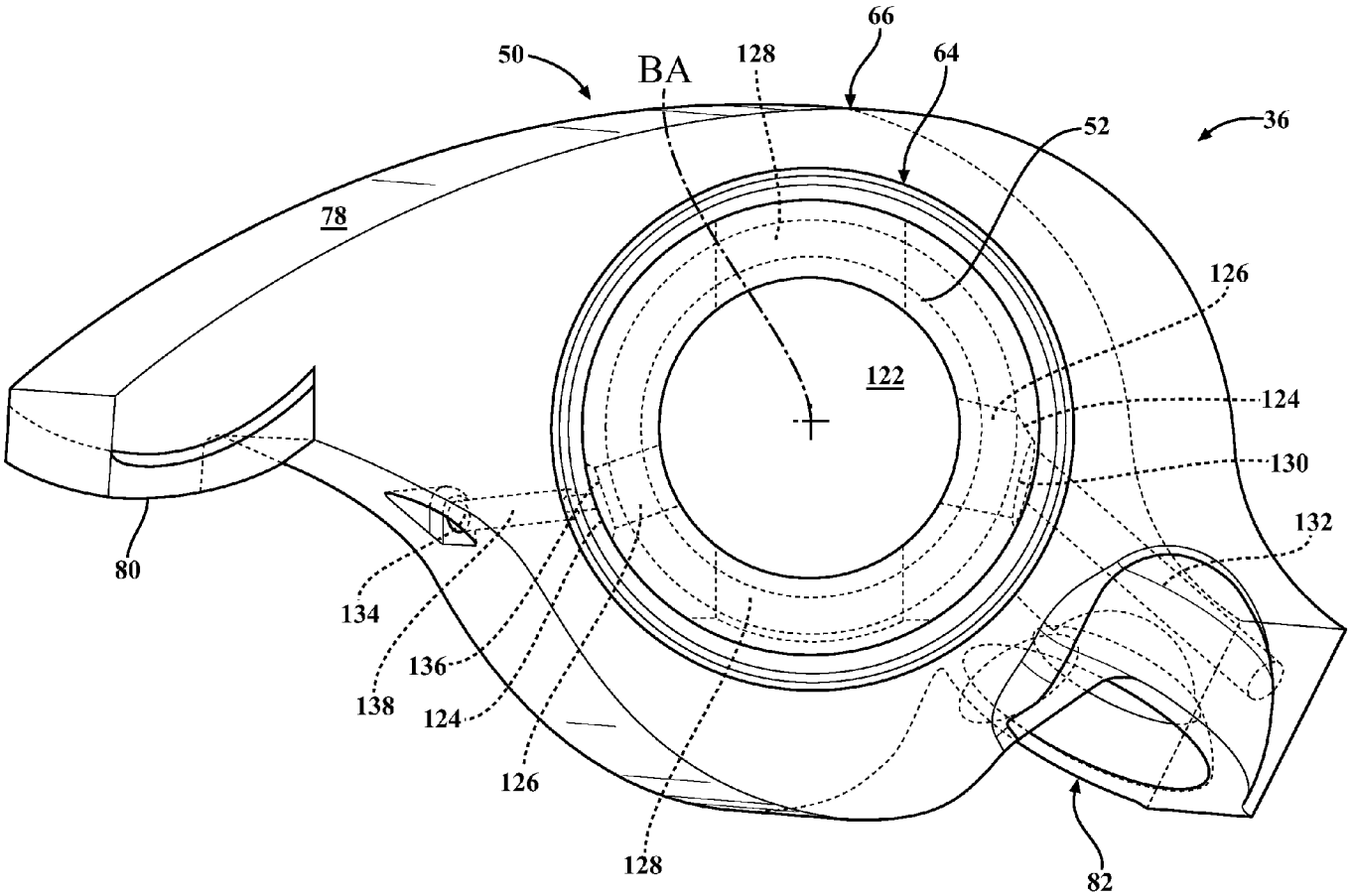
FIG. 12 is an enlarged front plan view of the rocker arm assembly and shaft of FIG. 2 with hidden lines visible, showing additional detail of oil flow paths.

Referring now to FIGS. 3 and 12, as noted above, the valvetrain assembly 36 is lubricated by the oil pump 44 of the lubrication system 40 of the engine 20, whereby oil is typically translated between the oil pump 44, rocker arm assembly 50, intermediate member 48, and valve 38. More specifically, the inner surface 72 of the tube member 64 of the rocker arm assembly 50 is in fluid communication with the oil pump 44 so as to ensure smooth, consistent rotation of the rocker arm assembly 50 about the shaft 52, as described above. To that end, the shaft 52 includes an inner channel 122, a feed port 124, and a feed channel 126. The inner channel 122 is spaced from the outer bearing surface 76 and is in fluid communication with the oil pump 44 of the engine 20, typically via securing holes 128 in fluid communication with the oil pump 44 that are also used to attach the shaft 52 to the cylinder head 24 (see FIG. 13). The feed port 124 is defined in the outer bearing surface 76 of the shaft 52, and the feed channel 126 extends between the feed port 124 and the inner channel 122, thereby providing oil to the inner surface 72 of the tube member 64 of the rocker arm assembly 50.

Referring now to FIGS. 8, 9, and 12, as noted above, the rocker arm assembly 50 translates oil to the intermediate member 48 via the socket 82. To that end, the rocker arm assembly 50 includes a socket port 130 defined in the inner surface 72 of the tube member 64, and a socket channel 132 extending from the socket port 130 to the socket 82. More specifically, the socket channel 132 extends from the socket port 130 to the receiving cup 118 of the socket 82. Similarly, in one embodiment, the rocker arm assembly 50 includes a sprayer 134 disposed in the arm 66 adjacent to the pad 80. The sprayer 134 acts as a nozzle to direct oil to the valve 38. To that end, the rocker arm assembly 50 includes a spray port 136 defined in the inner surface 72 of the tube member 64, and a spray channel 138 extending from the spray port 136 to the sprayer 134. As shown best in FIG. 12, the spray port 136 is spaced from the socket port 130. Similarly, the socket channel 132 is spaced from the spray channel 138.

In this way, the present invention significantly reduces the complexity, cost, and packaging size of valvetrain assemblies 36, rocker arm assemblies 50, and associated components. Specifically, it will be appreciated that the present invention allows rocker arm assemblies 50 with complex geometry to be manufactured in low-cost, reliable, and consistent ways. Moreover, the present invention reduces the cost of manufacturing valvetrains 36 that have superior operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A rocker arm assembly for translating force between an intermediate member in communication with a camshaft of an internal combustion engine and a valve supported in a cylinder head of the engine, said rocker arm assembly comprising:

a tube member having first and second ends, a substantially cylindrical inner surface, and a tapered outer surface;

an arm having a body extending between a pad for engaging the valve of the engine and a socket for engaging the intermediate member of the engine, said body having a tapered bore disposed between said pad and said socket;

wherein said tapered bore of said body of said arm cooperates with said tapered outer surface of said tube member so as to define a lock for constraining said arm to said tube member at a predetermined position between said first end and said second end.

2. The rocker arm assembly as set forth in claim 1, wherein said body of said arm has opposing first and second sides, said tapered bore extending from said first side to said second side.

3. The rocker arm assembly as set forth in claim 2, wherein said tapered bore has a first perimeter, and a second perimeter, wherein said first perimeter is larger than said second perimeter.

4. The rocker arm assembly as set forth in claim 3, wherein a ratio between said first perimeter and said second perimeter is less than 1.02:1.

5. The rocker arm assembly as set forth in claim 2, wherein a longitudinal plane is defined between said first side and said second side of said arm, a bore axis is defined along said tapered bore, and said bore axis intersects said longitudinal plane at an obtuse first angle.

6. The rocker arm assembly as set forth in claim 5, wherein a reference plane is defined between said pad and said socket of said arm and intersects said longitudinal plane perpendicularly, and said bore axis is substantially parallel to said reference plane.

7. The rocker arm assembly as set forth in claim 5, wherein said obtuse first angle defines a supplementary second angle with respect to said longitudinal plane, each of said first angle and said second angle being less than 135-degrees.

8. The rocker arm assembly as set forth in claim 5, wherein a first distance is defined along said bore axis between said first end of said tube member and said second end of said tube member, a second distance is defined along said bore axis between said first end of said tube member and said pad of said arm, and said second distance is greater than said first distance.

9. The rocker arm assembly as set forth in claim 2, wherein a first area of said tube member is defined between said first side of said body of said arm and said first end of said tube member, a second area of said tube member is defined between said second side of said body of said arm and said second end of said tube member, and said first area is larger than said second area.

10. The rocker arm assembly as set forth in claim 2, wherein said socket includes:

an upper flange surface spaced from said first side and said second side of said arm;

an outer socket surface extending between and merging with said upper flange surface and at least one of said first side and said second side of said arm;

a receiving cup spaced from said upper flange surface for engaging the intermediate member of the engine; and a clearance cup disposed between and merging with said receiving cup and said upper flange surface.

11. The rocker arm assembly as set forth in claim 10, wherein said socket further includes a transition portion merging said body of said arm with at least a portion of said upper flange surface.

12. The rocker arm assembly as set forth in claim 10, wherein said upper flange surface of said socket is spaced from said tube member.

13. The rocker arm assembly as set forth in claim 10, further including a socket channel extending from said inner surface of said tube member to said receiving cup of said socket of said arm.

14. The rocker arm assembly as set forth in claim 13, further including:

a sprayer disposed in said arm adjacent to said pad; and a spray channel spaced from said socket channel and extending from said inner surface of said tube member to said sprayer.

15. The rocker arm assembly as set forth in claim 1, further including a joint that cooperates with said lock so as to operatively attach said arm to said tube member.

16. The rocker arm assembly as set forth in claim 15, wherein said tube member and said arm are manufactured from metal.

17. The rocker arm assembly as set forth in claim 15, wherein said joint is further defined as a braze filler.

18. The rocker arm assembly as set forth in claim 15, wherein said joint is further defined as a weld pool.

19. The rocker arm assembly as set forth in claim 1, wherein said inner surface of said tube member has a substantially constant diameter between said first end and said second end so as to define a congruent bearing surface.

20. A valvetrain assembly for translating force between an intermediate member in communication with a camshaft of an internal combustion engine and a valve supported in a cylinder head of the engine, said valvetrain assembly comprising:

an elongated shaft operatively attached to the engine; and a rocker arm assembly rotatably supported on the shaft, said rocker arm assembly including:

a tube member having first and second ends, a substantially cylindrical inner surface, and a tapered outer surface;

an arm having a body extending between a pad for engaging the valve of the engine and a socket for engaging the intermediate member of the engine, said body having a tapered bore disposed between said pad and said socket;

wherein said tapered bore of said body of said arm cooperates with said tapered outer surface of said tube member so as to define a lock for constraining said arm to said tube member at a predetermined position between said first end and said second end.

21. The valvetrain assembly as set forth in claim 20, wherein said body of said arm has opposing first and second sides, said tapered bore extending from said first side to said second side.

22. The valvetrain assembly as set forth in claim 21, wherein said tapered bore has a first perimeter, and a second perimeter, wherein said first perimeter is larger than said second perimeter.

23. The valvetrain assembly as set forth in claim 22, wherein a ratio between said first perimeter and said second perimeter is less than 1.02:1.

24. The valvetrain assembly as set forth in claim 21, wherein a longitudinal plane is defined between said first side and said second side of said arm, a bore axis is defined along said tapered bore, and said bore axis intersects said longitudinal plane at an obtuse first angle.

25. The valvetrain assembly as set forth in claim 24, wherein a reference plane is defined between said pad and said socket of said arm and intersects said longitudinal plane perpendicularly, and said bore axis is substantially parallel to said reference plane.

26. The valvetrain assembly as set forth in claim 24, wherein said obtuse first angle defines a supplementary second angle with respect to said longitudinal plane, each of said first angle and said second angle being less than 135-degrees.

27. The valvetrain assembly as set forth in claim 24, wherein a first distance is defined along said bore axis between said first end of said tube member and said second end of said tube member, a second distance is defined along said bore axis between said first end of said tube member and said pad of said arm, and said second distance is greater than said first distance.

28. The valvetrain assembly as set forth in claim 21, wherein a first area of said tube member is defined between said first side of said body of said arm and said first end of said tube member, a second area of said tube member is defined between said second side of said body of said arm and said second end of said tube member, and said first area is larger than said second area.

29. The valvetrain assembly as set forth in claim 21, wherein said socket includes:

an upper flange surface spaced from said first side and said second side of said arm;

an outer socket surface extending between and merging with said upper flange surface and at least one of said first side and said second side of said arm;

a receiving cup spaced from said upper flange surface for engaging the intermediate member of the engine; and a clearance cup disposed between and merging with said receiving cup and said upper flange surface.

30. The valvetrain assembly as set forth in claim 29, wherein said socket further includes a transition portion merging said body of said arm with at least a portion of said upper flange surface.

31. The valvetrain assembly as set forth in claim 30, further including a joint that cooperates with said lock so as to operatively attach said arm to said tube member.

32. The valvetrain assembly as set forth in claim 31, wherein said tube member and said arm are manufactured from metal.

33. The valvetrain assembly as set forth in claim 31, wherein said joint is further defined as a braze filler.

34. The valvetrain assembly as set forth in claim 31, wherein said joint is further defined as a weld pool.

35. The valvetrain assembly as set forth in claim 29, wherein said upper flange surface of said socket is spaced from said tube member.

36. The valvetrain assembly as set forth in claim 29, further including a socket channel extending from said inner surface of said tube member to said receiving cup of said socket of said arm.

37. The valvetrain assembly as set forth in claim 36, further including:

a sprayer disposed in said arm adjacent to said pad; and a spray channel spaced from said socket channel and extending from said inner surface of said tube member to said sprayer.

38. The valvetrain assembly as set forth in claim 20, wherein said inner surface of said tube member has a substantially constant diameter between said first end and said second end so as to define a congruent bearing surface.

* * * * *